United States Patent [19]

Duran

[11] Patent Number: 4,753,176

[45] Date of Patent: Jun. 28, 1988

[54] CREMATORY CHAMBER FLOOR LINER FACILITATING CONTAINMENT AND REMOVAL OF CREMAINS

[75] Inventor: Reginald F. Duran, Fullerton, Calif.

[73] Assignee: The Reginald Corporation, Fullerton, Calif.

[21] Appl. No.: 25,264

[22] Filed: Mar. 12, 1987

[51] Int. Cl.[4] ..... F23G 1/00

[52] U.S. Cl. ..... 110/194; 110/346

[58] Field of Search ..... 110/194, 334, 346

[56] References Cited

U.S. PATENT DOCUMENTS 4,407,236 10/1983 Schukei et al. ..... 122/382 X 4,603,644 8/1986 Brookes ..... 110/194

FOREIGN PATENT DOCUMENTS 0037408 4/1981 Japan ..... 110/194

*Primary Examiner*—Edward G. Favors

*Attorney, Agent, or Firm*—Stetina and Brunda

[57] ABSTRACT

A unitary floor liner formed of a refractory or metal material is disclosed for use in crematory chamber. The liner is seamless for collection of cremains upon its top surface, which may exhibit a shallow central depression. The liner may include guide structures formed upon its top surface, which are interoperative with complementary structures formed on cleaning tools, particularly with wheels on powered breaking/vacuuming cleaning tools, for positionally guiding such cleaning tools along the length of the liner. By such guidance cremains may be thoroughly cleaned from the entire floor area of the crematory chamber even while the chamber is still at an elevated temperature following a cremation. Alternatively, the floor liner may be extracted from the crematory chamber, and cremains may be thoroughly cleaned from its upper surface.

39 Claims, 2 Drawing Sheets

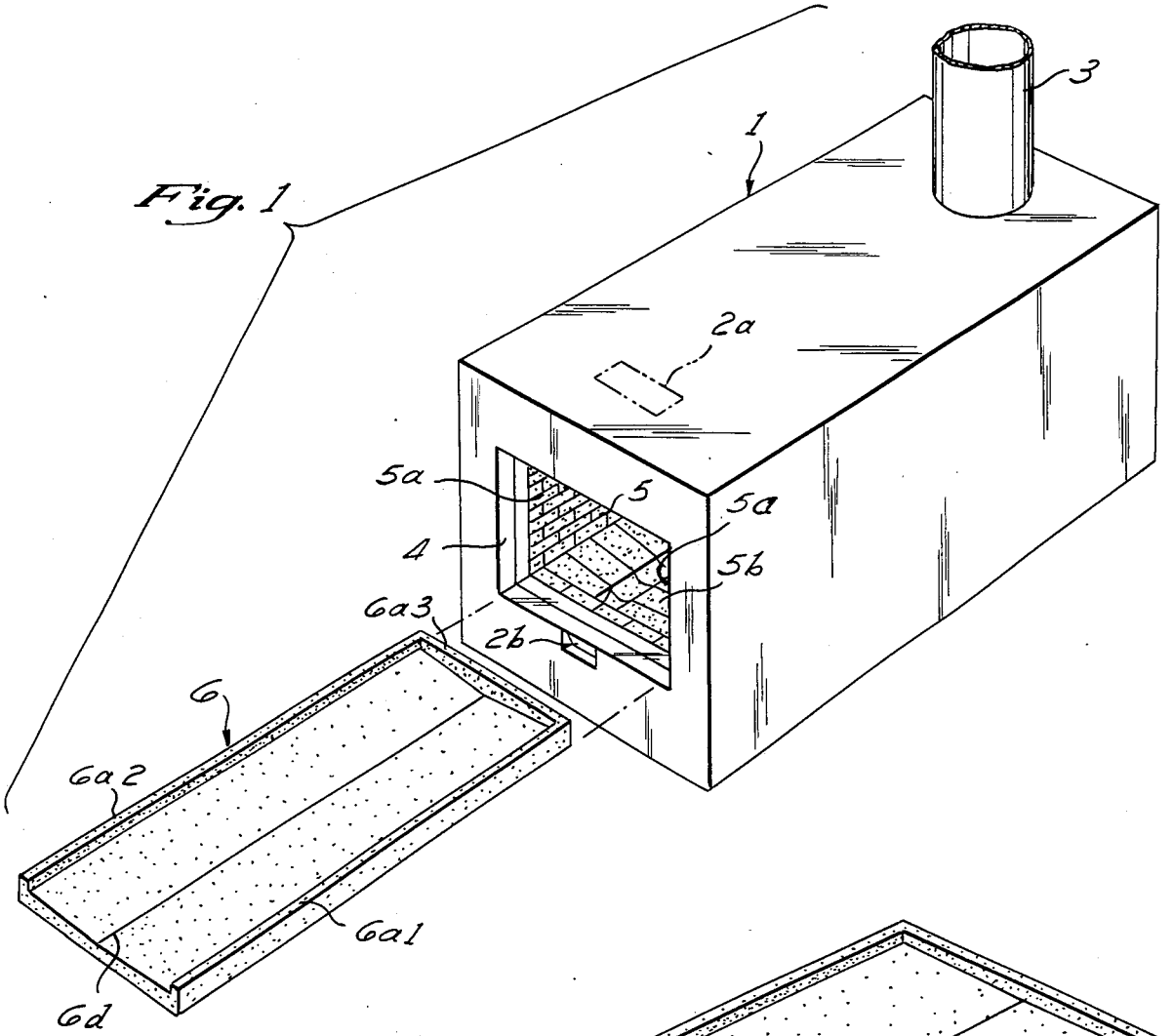
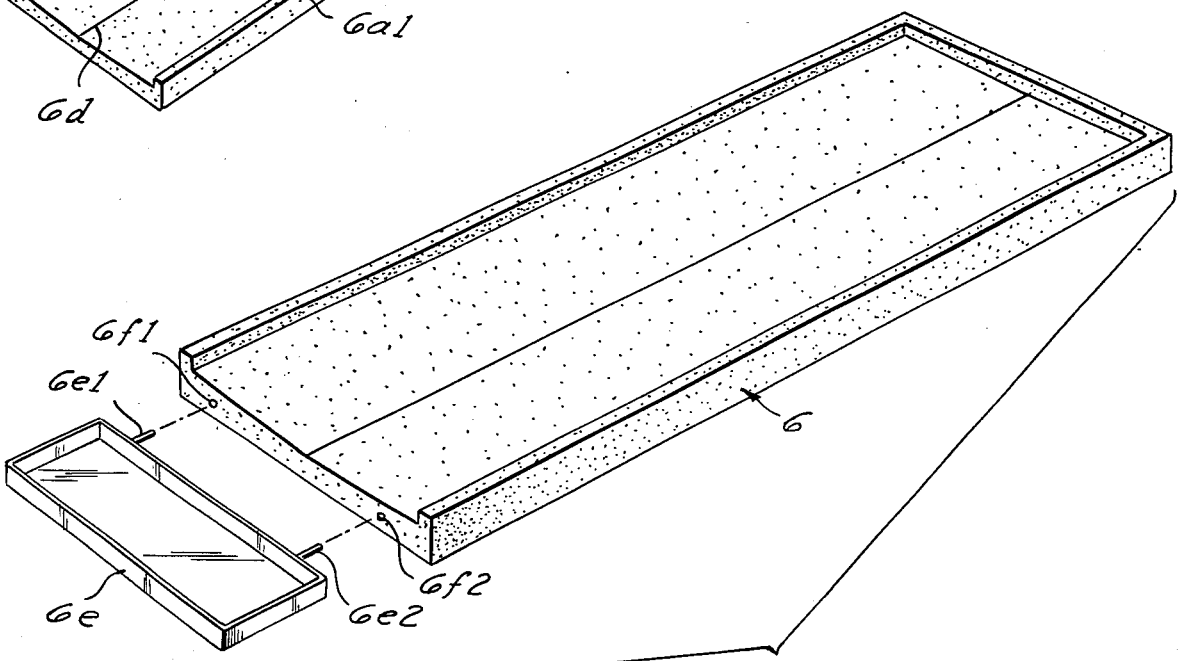
Fig. 2

Fig. 3
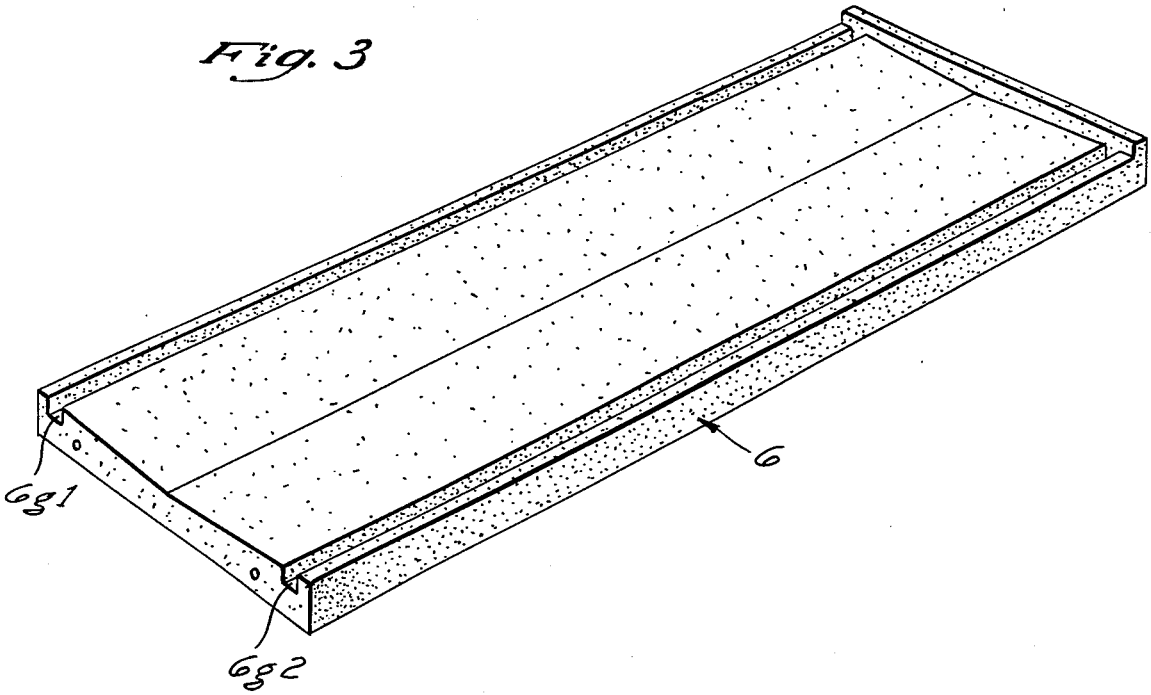
Fig. 4
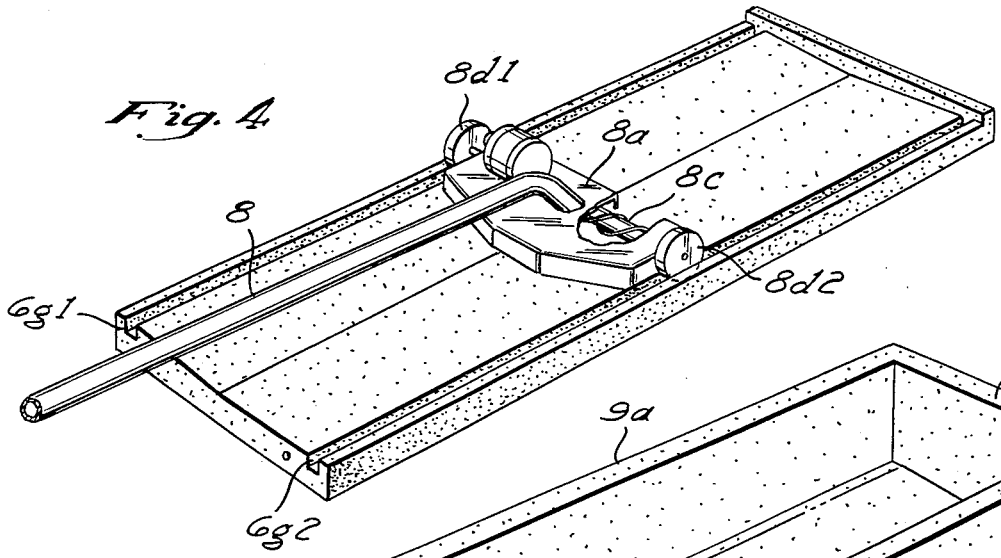
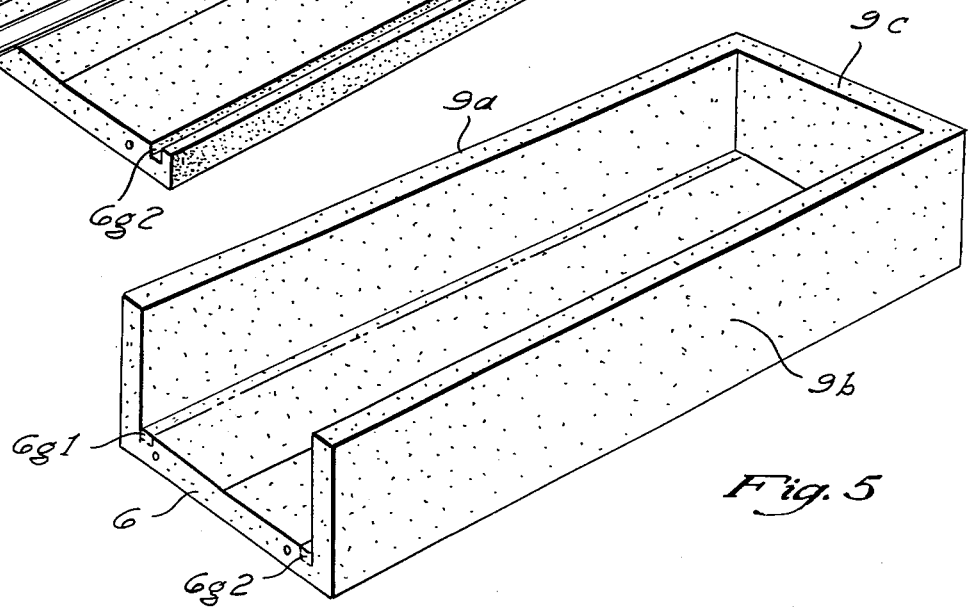
Fig. 5

CREMATORY CHAMBER FLOOR LINER FACILITATING CONTAINMENT AND REMOVAL OF CREMAINS

BACKGROUND OF THE INVENTION

1. Field of the Invention

The present invention deals with the construction, repair and refurbishment of the floor of crematory chamber with a surface particularly supporting the quick, thorough, and easy removal of cremains.

2. Discussion of the Relevant Art

The floors of crematory chambers, or retorts, are commonly made of refractory tile, fire brick, or castable metal materials. The modular nature of such floors facilitates traditional methods of piecewise construction and repair. However, the joints between and/or the cracks within the floor tiles or bricks are subject to collect cremains. This is especially true if, as is often the case, certain tiles or bricks are broken, cracked, or misaligned. Heretofore, these normal irregularities in the floor surface of a crematory chamber although being undesireable have not presented significant or insurmountable problems. However, under existing and prospective new state statutes, there is an emergent requirement that, as nearly as is possible, 100% of the recoverable cremains from each separate cremation should be recovered, and that there should be no commingling of the cremains of successive cadavers processed within a same crematory chamber. Any joints, cracks, depressions or other irregularities within the floor of a crematory chamber impair and even frustrate compliance with these laws.

For an example of statutory requirements prohibiting commingling of cremains, Section 7054.7 of the California Health and Safety Code states: "Except with the express written permission of the person entitled to control the disposition of the (crematory) remains, no person shall cremate the remains of more than one person at the same time in the same cremation chamber or dispose of in cremated remains in such a manner . . . that the remains are commingled with those of another person."

In the prior art the removal of cremains from crematory chambers has been somewhat crude. Cremains have traditionally been removed from crematory chambers by the use of handled tools, including brooms. A first improvement to this traditional apparatus and method, invented by the inventor of the present invention, is taught in U.S. Pat. No. 4,473,012 issued Sept. 25, 1984 for APPARATUS AND METHOD FOR REMOVING CREMATED REMAINS FROM A CREMATORY FURNACE. A system is taught in such patent for the breaking and vacuum removing of cremains from a crematory furnace, or chamber. The system includes a vacuum wand which is equipped with a grinder and with a vacuum head for breaking cremains into fragments. The broken fragments are then vacuumed and mechanically processed outside the furnace.

This improved, powered, system for the removal of cremains from a crematory chamber can successfully scavenge some of the cremains which might otherwise escape cleaning by manual means. However, even this system experiences difficulty in the thorough vacuum cleaning of a rough or broken crematory chamber floor. Additionally, the grinder and vacuum head must be manipulated into all appropriate areas and recesses of the crematory chamber by a human operator reaching through the open door of a crematory chamber and holding onto an elongate wand to which such vacuum head is attached. Insofar as the floor area of the crematory chamber is not thoroughly and conscientiously vacuumed in all areas by the operator, cremains may be failed to be recovered.

Finally, both the prior art vacuum and manual systems normally require, since a human operator is actively involved in positioning the cleaning tool, that a crematory chamber should be cleaned only after such chamber has cooled substantially to room temperature.

SUMMARY OF THE INVENTION

The present invention has aspects concerning a crematory chamber unitary floor liner which is used in the construction, repair and/or refurbishment of crematory chambers. It has further aspects regarding creation of a seamless crematory chamber floor surface which facilitates thorough and complete cleaning. It has further aspects regarding contours upon a crematory chamber floor surface, which contours present a guide structure used to cooperatively engage a complementary structure formed upon a cleaning tool (such as a vacuum cleaning tool) in order to guide such a cleaning tool along a path which assures full and complete coverage of the entire crematory chamber floor area and the removal of all the cremains distributed thereupon. Finally, the present invention has aspects regarding a contoured crematory chamber floor surface which particularly supports, and improves, that existent system and method for removing cremated remains from a crematory furnace which is taught within U.S. Pat. No. 4,473,012. Finally, the present invention has aspects regarding a floor liner, particularly one with sidewalls extending upwards, which may be extracted from a crematory chamber after a cremation in order that cremains may be cleaned from the surface of such liner in a position outside, or substantially outside, of the crematory chamber.

In one aspect, the present invention presents a method and an apparatus for the construction, repair and refurbishment of crematory chamber floors. The method employs the apparatus of a unitary floor liner. The method includes the steps of exposing a level access to the crematory chamber floor equivalently to that access which is normally required by a casket, and sliding the unitary floor liner (which is very heavy) into the chamber equivalently as a casket would be slid into such chamber. The floor liner may optionally attach a removable cremains reservoir. It may also optionally present a contoured guide structure which cooperatively engages a complementary structure upon a cleaning tool. The guide structure is preferably a linear ridge or channel which is disposed along at least one, and preferably along both, of the two upper-surface long-axis edge-margins of the unitary floor liner.

In another aspect, the present invention is embodied in a seamless crematory chamber floor surface of refractory material. Such a seamless floor surface is preferably realized by that same unitary floor liner which is separately insertable, including during retrofit, into a pre-existing crematory chamber. The seamless floor surface may alternatively be realized by laying a continuous refractory cement floor. The seamless floor surface is upon the entire floor area of the crematory chamber. The cremains collected on the smooth and seamless surface are readily thoroughly cleaned from such surface. Just like the floor liner of which it is preferably comprised, the seamless crematory chamber floor surface may optionally present the contoured guide structure which cooperatively engages the cleaning tool.

In another aspect, the present invention concerns provision of contours forming the guide structures upon a crematory floor, whether or not such a floor is comprised of a unitary liner and whether or not such floor is seamless. The contoured guide structures are particularly co-operatively interoperative with complementary structures on cleaning tools, especially powered grinding and vacuum heads for breaking cremains into fragments and removing the fragments by vacuuming. The guide structures assure the complete and thorough coverage of the floor area of a crematory furnace by the cleaning tools, and the recovery of all cremains.

In still another aspect, the present invention concerns a unitary floor liner which is upon the floor of a crematory chamber during a cremation and which is, subsequent to the cremation, slid out or substantially out of the crematory chamber to aid access for the thorough cleaning of cremains from off the surface of the liner. To ensure that all cremains are collected upon the liner and not elsewhere within the crematory chamber, the removable liner preferably has upwardly extending sidewalls.

BRIEF DESCRIPTION OF THE DRAWINGS

FIG. 1 is a perspective view depicting a first variant embodiment of the unitary crematory chamber floor liner of the present invention disposed in a position to be slid into a crematory chamber.

FIG. 2 is a perspective view depicting a second variant embodiment of the unitary crematory chamber floor liner of the present invention, which liner attaches a crematory reservoir.

FIG. 3 a perspective view depicting a third variant embodiment of the unitary crematory chamber floor liner of the present invention, which liner incorporates guide structures in the form of channels within the top surface of the liner near its edge margins.

FIG. 4 is a perspective view depicting in diagrammatic form the co-operative interaction of that guide structure in the form of channels which was shown in FIG. 3 with a vacuum/breaking head for the purpose of guiding the head in the cleaning of cremains.

FIG. 5 is a perspective view depicting a fourth variant embodiment of the present invention.

DESCRIPTION OF THE PREFERRED EMBODIMENT

The present invention concerns the floor surface, and the contours of the floor surface, of a crematory chamber, or retort. A prior art crematory chamber is shown in perspective view in FIG. 1. The crematory chamber 1 has a main burner disposed in either or both of areas 2*a* and 2*b* which generates the prolonged high temperatures within the chamber which are required for cremation. The gasses resultant from the combustion and cremation process are evacuated through various exhaust systems 3. The base, top, side wall, and end wall construction of crematory chamber 1 is normally complex in order to support stringent mechanical and thermal requirements. All walls normally incorporate external steel plates, internal steel support beams, insulating air spaces and/or insulating material (all not shown) and refractory material 5 which lines the interior cavity of the crematory chamber 1.

In the perspective illustration of FIG. 1, a view is provided through door opening 4 (door not shown) into the interior cavity of crematory chamber 1. Within such cavity refractory, plural fire bricks 5*a* line the side walls of the chamber and refractory tiles 5*b* line the floor of the chamber. The use of tile and brick may be interchanged in various combinations. Each tile, and/or brick, exhibits joints, and possibly also exhibits cracks or chips or damaged edges, caused through use or during installation with adjacent tiles and/or bricks. These small joints and minor defects normally do not interfere with the thermal function of the crematory chamber 1 to effect cremation.

The joints and cracks between the base refractory tiles (or bricks) 5*b*, do, however, collect and accumulate cremains which are distributed upon the floor of the crematory chamber 1 after the cremation process. Those cremains which are collected in joints and cracks are particularly difficult to scavenge by the normal cleaning process of reaching into a cooled chamber 1 through door opening 4 and pulling and sweeping with long-handled tools the cremains into reservoirs or pans (not shown). Alternatively to the manual collection of the cremains, a powered cremains breaking and vacuuming apparatus as is taught in U.S. Pat. No. 4,473,012 may be employed. This vacuuming apparatus, although preferable to manual cleaning techniques, may also experience difficulty in scavenging cremains collected in floor cracks and joints.

Regardless of the method by which the cremains are collected, the recovery process is normally delayed until the crematory chamber 1 has cooled. Therefore the recovery process is both time consuming and simultaneously exhibits difficulty in recovering all of the cremains, and only those cremains, from a single cremation. Accordingly, it is desired to improve both the thoroughness and efficiency of retrieving cremains.

In accordance with the solution of the present invention to requirements for retreiving cremains, a unitary floor liner 6 (shown in FIG. 1) is constructed preferably of one piece of refractory material. The floor liner 6 is approximately 3' wide by 7' long by 1½" thick. The liner is preferably made by molding refractory cement material or casting refractory metals. Particularly, the liner is preferably made from NU-BLOCK TM refractory material and Dry Vibration Cement (DVC), both available from the Norton Company, Industrial Ceramics Division, 1 New Bond Street, Worcester, Mass. 01608.

NU-BLOCK is a polymer-bonded refractory well suited for crematory applications. The refractory material is a tough, long-wearing fused alumina. It is a proprietary refractory/polymer formulation developed jointly by Norton and Union Carbides. It is substantially denser than competitive refractories such as low moisture castables and conventional rammed refractories which weigh 10–20% less than NU-BLOCK, which has a density of 200 pounds per cubic foot. NU-BLOCK is also up to five times stronger at operating temperature than other refractories, with a Hot Modulus Of Rupture (HMOR) of 1135 psi at 2700 degrees F. NU-BLOCK has a high resistance to chemical attack. This is because NU-BLOCK contains no conventional cement (CaO), its oxidation rate is extremely low, and its density serves to lengthen service life. NU-BLOCK is available in preforms at lengths up to 15 feet. It has a typical oxidized chemistry of 75.8% $Al_2O_3$, 17.2% SiC, 2.8% $SiO_2$, 1.5% $TiO_2$, 0.6% $Fe_2O_3$, and 2.1% Other.

Like NU-BLOCK, Norton Dry Vibration Cement (DVC) is moisture-free refractory cement that requires no dry-out time. The absence of water virtually eliminates the possibility of post-installation spalling or explosions. After installing a liner of NU-BLOCK material, the DVC back-up lining is rapidly vibrated into place with no curing or dry-out time required. Conventional rams require 2–6 hours dry-out. Alternative castable cements require at least 24 hours of curing and heating. Used as a working lining in induction furnaces for more than 20 years, DVC is back-up lining that provides positive break-out protection. If a DVC back-up and NU-BLOCK working liner finally need to be replaced, the DVC separates easily from the NU-BLOCK liner, leaving the liner undamaged.

Alternatively to a preferred fabrication of the unitary floor liner 6 from refractory preforms and/or cements, the liner of the present invention may be made of metal consisting of steel and cast-iron and of alloy parts. The alloy parts exposed to the direct heat of the furnace are of nickel or chromium alloys and are made heavy enough to offset the loss of strength at high temperatures. They are resistant to oxidation at temperatures below 2000° F.(1093° C.). Particularly in the present floor liner application, these metals should be substantially unaffected by temperatures up to 3000° F. Other materials such as exotic metals having superior temperature resistance and wear characteristics, are contemplated as suitable for use in implementing the crematory chamber floor liner in accordance with the present invention.

Continuing in FIG. 1, the liner is slid into the crematory chamber 1 through the normal door opening 4. Normally, this door opening 4 is as wide, or wider than, the crematory chamber into which a casket or cadaver is loaded lengthwise. In rare cases the size of the door 4 may have to temporarily enlarged in order to accommodate placement of the floor liner 6. Because of its elongate and thin structure, its high weight, and the fracturable material of its construction, the liner 6 is subject to cracking or damage before permanent placement if it is subjected to strong physical forces or mishandling. However, crematories which employ cremation chambers similar to cremation chamber 1 normally have materials handling capability suitable for the movement and loading of large and heavy caskets. These same materials handling equipments—including lifts, slides, loaders, and the like—are normally readily useable to insert the unitary floor liner 6 within crematory chamber 1.

Continuing in FIG. 1, the unitary floor liner 6 for a crematory chamber presents in a first variant embodiment perimeter ridges **6*a*1, 6*a*2 adjacent the side-edge margins of the top surface. A ridge 6*a*3 may also be presented at the rear-edge margin of the top surface. All these ridges serve to define the central area of the floor liner 6 in which area cremains will be collected. The ridges may additionally serve to guide (in a manner which will be shown) tools, whether manual or powered, which are used to clean cremains from the surface of floor liner 6. To further aid that the cremains should be retained upon a central surface of floor liner 6 during the cremation process, the central surface is moderately angularly sloped toward a central depression, or groove 6*d*. Normally the floor liner 6 occupies that entire floor area of the crematory chamber 1 which was previously covered by fire tiles, or bricks, 5*b***.

A second variant embodiment of the apparatus of the present invention is shown in FIG. 2. In this embodiment a unitary floor liner 6 attaches at its forward edge (which edge is proximate the door 4 of the crematory chamber 1, shown in FIG. 1) a cremains reservoir **6*e*. The cremains reservoir may be either within the crematory chamber 1 during cremation, or may be attached to the unitary floor liner 6 only when the crematory chamber 1 is opened for cleaning. Such a cremains reservoir 6*e* need not invariably be shallow, as illustrated, but may be interoperative with the existing cremains reservoir of the crematory chamber 1. This existing reservoir sometimes exists in area 2 (shown in FIG. 1). For interoperability, the cremains reservoir 6*e* may funnel or communicate cremains into an existing reservoir of the crematory chamber. It is not required that the cremains reservoir 6*e* should be inserted into the cremation chamber 1 simultaneously with the insertion of floor liner 6**.

When the cremains reservoir **6*e* is substantially coplanar with the unitary floor liner 6 as illustrated in FIG. 2, then it presents a shallow depression at the foot of the floor liner 6 into which the cremains may be gathered by a sweeping of the floor liner 6. The crematory remains reservoir 6*e* may be permanently attached to the unitary floor liner 6 by means such as dowel pins 6*e*1, 6*e*2. Preferably, however, the cremains reservoir 6*e* is preferably removably attached to the floor liner 6, preferably by dowel pins 6*e*1, 6*e*2 which slide into complementary apertures 6*f*1, 6*f*2 within the floor liner 6. In such a removable configuration, the cremains reservoir 6*e* is first used to receive the cremains during cleaning of the floor liner 6 with a tool, and is then temporarily detached for emptying. Especially if located within the crematory chamber 1 during cremation, the cremains liner 6*e*** is normally formed from a refractory material which is substantially impervious to the high temperature of cremation.

A third preferred variant embodiment of the apparatus of the present invention is shown in FIG. 3. The unitary floor liner 6 shown therein possess channels, or grooves, **6*g*1, 6*g*2, at the edge margins of the top surface. Either these grooves, 6*g*1, 6*g*2, or, alternatively, the ridges 6*a*1, 6*a*2 previously seen in the embodiment shown in FIG. 1 and FIG. 2, may serve as a guide structure which cooperatively engages a complementary-shaped structure upon a cleaning tool for guiding such cleaning tool along a path over and upon the floor liner 6**.

One such cleaning tool exhibiting a complementary structure is illustrated in FIG. 4 as vacuum wand 8 connected to vacuum head **8*a*. Such a vacuum head 8*a* may employ a rotary breaker bar 8*c* in accordance with the teaching of U.S. Pat. No. 4,473,012, the disclosure of which is expressly incorporated herein by reference. However, the particular complementary structure which is presented upon vacuum head 8*a* is the wheels 8*d*1, 8*d*2 which respectively engage grooves 6*g*1, 6*g*2 upon slab 6. It may be well envisioned that similar wheels, guide rollers, or the like could also cooperatively engage the ridges 6*a*1, 6*a*2 shown in FIG. 2**.

A guide structure in the form of channels, such as channels **6*g*1, 6*g*2 shown in FIGS. 3 and 4, has been found to be preferred over a guide structure in the form of ridges even though such channels would seemingly collect cremains. This is because these channels provide a high level of positive positional control which is especially useful when vacuum head 8*a* is configured to subtend the entire width of slab 6**, as illustrated in FIG.

4. Moreover, the suction area of the vacuum head 8*a* may be sufficiently wide and the housing of such head may be appropriately configured so that the area under the wheels 8*d*1, 8*d*2 and within the channels 6*g*1, 6*g*2 is appropriately vacuumed.

Moreover in the method of the present invention, and importantly, when the floor liner of a crematory chamber is cooperatively interoperative with a cleaning tool for the guidance of the cleaning tool, then the cleaning may be conducted at elevated temperatures before the crematory chamber has cooled. This expedited cleaning is enabled because of the elimination of any stringent requirements for manual guidance and/or positioning of the cleaning tool. The cleaning tool is instead guided by a structure upon the floor of the crematory chamber. Also in such a method of expedited cleaning the cleaning tool access to the crematory chamber, such as the access required for vacuum wand 8 and its associated components, may be made considerably more constricted than that larger access normally provided through the crematory chamber opening 4 (shown in FIG. 1) which receives a casket. Through such a constricted size access the chamber may be cleaned quickly, efficiently, and effectively even while still at considerably elevated temperatures. This helps that the crematory chamber may be more quickly cycled to a next subsequent cremation. Indeed, when the normal access for momentary loading of a casket for such cremation is finally provided, the crematory chamber will normally still not have cooled to room temperature, and may be reheated with attendant savings in energy.

A fourth preferred variant embodiment of the apparatus of the present invention is shown in FIG. 5. The unitary floor liner 6 shown therein is specially adapted to be slid into and out of a cremation chamber for each cremation. The casket may be loaded onto the liner 6 either before or after insertion of the liner 6 into crematory chamber 1 (shown in FIG. 1). After completion of the cremation, and afer the chamber has suitably cooled, the liner 6 is either partially or completely slid from the chamber, bearing the cremains upon its surface, in order to improve access for cleaning. The liner may optionally incorporate guide structures in the form of channels, or grooves 6*g*1, 6*g*2 (shown in dashed line), but need not so incorporate such structures. The liner 6 preferably incorporates upwardly extending sidewalls 9*a*, 9*b*, and rear wall 9*c* which each rise for a nominal height of 18 inches. These walls help to ensure that all cremains are captured on, and remain on, the central top surface of liner 6 both during the cremation, during the extraction of the liner from the crematory chamber, and during the cleaning of cremains from the liner at its position fully or partially extracted from the crematory chamber.

Therefore, having seen variants of the apparatus of the present invention which do and which do not incorporate guide structures, it should be recognized that either the seamless crematory chamber floor surface and/or the crematory chamber floor incorporating guide structures can also be realized without employment of a floor liner. A seamless floor to a crematory chamber can be created by laying refractory cement. However, since a large composite floor is more severely stressed by large thermal gradients both within the crematory chamber and from the interior to the exterior of the crematory chamber than is the unitary floor liner—which may creep slightly as required to relieve stress—a composite seamless floor is more prone to crack than is an integral unitary seamless floor liner.

Guide structures may additionally be created upon the floor of a crematory chamber separately from any floor liner and/or seamless floor surface. Such structures can be formed from refractory cement (whether or not the entire floor is also lined with such cement), or from ridges or channels created with and from refractory tile or brick, or from refractory metals such as steel rails. The provision of durable guide structures in accordance with the present invention, even without more, provides some benefit to aid through and expedited cleaning. However, the guide structures in accordance with the present invention are synergistically interactive with a seamless floor (which is its preferably realized by a floor liner) in accordance with the present invention for optional containment and removal of cremains.

In accordance with the preceding discussion, certain variants in the structure, operation, and fabrication of crematory floors and floor surfaces in accordance with the present invention will suggest themselves to practioners in the art of designing, operating and refurbishing crematory chambers. For example, guide structures of forms other than rails or channels, and of numbers different than two, could be created upon the floor surface of a crematory chamber regardless of whether or not such floor is of seamless construction or is lined. For example, a powered cleaning mechanism which is cooperatively interoperative with a floor, and/or with walls, presenting guide channels could be made completely automated with no manual insertion and/or guidance whatsoever required of such an automated cleaning mechanism. Corresponding to these and other possible variations, the present invention should be broadly perceived to be embodied in a liner for the floor of a crematory chamber, in a seamless floor surface for a crematory chamber, in improved floor contours within a crematory chamber, in an improvement to the method of cleaning a crematory chamber, and in an improvement to a particular vacuum system of cleaning a crematory chamber.

Therefore the following claims should be interpreted in accordance with their express language, only, and not merely in accordance with those preferred embodiments within which the present invention has been taught.

What is claimed is:

1. In a system for removing cremains from a crematory furnace, having means for breaking cremains within a crematory furnace into fragments less than a predetermined size, a vacuum line having a first end connected to said means for breaking, a housing connected to a second end of said vacuum line, a blower, connected to said vacuum line to form a partial vacuum therein for suctioning the fragments from the crematory furnace in the housing, and means for collecting fragments suctioned by the blower into the housing, an improvement comprising:

a crematory furnace floor surface co-operatively interoperative with the means for breaking to positionally guide the means for breaking along and upon the entirety of a floor area of the crematory furnace, wherein the means for breaking is positionally guided for breaking substantially all cremains as are distributed upon the floor of the crematory furnace.

2. In the system for removing cremains from a crematory furnace according to claim 1 augmented by the means for breaking further having wheels, the improvement to this augmented system for removing remains from a crematory furnace according to claim 1 wherein the crematory furnace floor surface presents guide structures linearly along the floor area which guide structures engage and physically guide the wheels of the means for breaking.

3. The improvement to the augmented system for removing cremains from a crematory furnace according to claim 2 wherein the guide structures comprise:

rails upon the floor of the crematory furnace.

4. The improvement to the augmented system for removing cremains from a crematory furnace according to claim 2 wherein the guide structures comprise:

grooves within the floor of the crematory furnace.

5. The improvement to the system for removing cremains from a crematory furnace according to claim 1 wherein the crematory furnace floor surface is seamless without cracks or joints.

6. In a method of removing cremated remains from a crematory furnace including the steps of breaking the cremated remains into fragments, and forming a partial vacuum in a vacuum line having an input end positioned within the crematory furnace adjacent the fragments of the cremated remains in order to remove the fragments from the crematory furnace, an improvement comprising:

positioning the input end of the vacuum line by aid of pre-existing guide structures upon the floor of the crematory furnace, which guide structures cooperatively engage for positional guidance the input end in order that it may be successively positioned adjacent the cremated remains distributed on the entirety of the floor of the crematory furnace, and in order that substantially all of the cremated remains may be removed from the crematory furnace.

7. A method of using a crematory chamber comprising:

inserting both a unitary seamless floor liner and corpse upon this floor liner into a crematory chamber; then performing a cremation turning the corpse into cremains but not substantially affecting the floor liner; then extracting the floor liner from the crematory chamber with the cremains upon its upper surface; and then cleaning the cremains from the upper surface of the unitary seamless floor liner;

wherein substantially all cremains are extracted from the chamber upon the floor liner because there is no other location whereat appreciable cremains could collect;

wherein substantially all cremains are cleaned from the extracted floor liner because access and visibility for cleaning are unimpaired.

8. The method of using a crematory chamber according to claim 7 which before said performing further comprises:

equipping the floor liner with sidewalls and with a back wall, opposite to the entrance into the crematory chamber, which walls serve to capture, and to retain, cremains upon the top surface of the liner both during the performing of the cremation and during the extracting.

9. In a cremation system including a combustion chamber having a floor of refractory material, the improvement comprising:

a unitary floor liner of refractory material sufficient to withstand crematory temperatures;

said unitary floor liner being inserted into the combustion chamber;

said floor liner being generally coextensive with the area of the combustion chamber floor and having a cremains reservoir removably mounted adjacent one end thereof.

10. In a cremation system including a combustion chamber having a floor of refractory material, the improvement comprising:

a unitary floor liner of refractory material sufficient to withstand crematory temperatures;

said unitary floor liner being inserted into the combustion chamber;

said unitary floor liner being generally coextensive with the area of the combustion chamber floor and including a guide structure which cooperatively engages a complementary structure upon a cleaning tool for guiding such cleaning tool along a path upon said unitary floor liner for the purpose of cleaning cremains from a surface of said unitary floor liner.

11. The improvement to a cremation system according to claim 10 wherein said guide structure is linear configuration so as to guide said cleaning tool along a straight line path along the length of said unitary floor liner.

12. The improvement to a cremation system according to claim 10 wherein said guide structure is formed along and is parallel to at least one edge of said unitary floor liner.

13. The improvement to a cremation system according to claim 10 wherein said guide structure comprises a ridge.

14. The improvement to a cremation system according to claim 11 wherein said guide structure comprises a channel which cooperatively engages a complementary structure of said cleaning tool.

15. A method of refurbishing the floor of a crematory combustion chamber, said method comprising:

forming a unitary slab of material sufficient to withstand temperatures encountered during cremation, said unitary slab being sized to be received within said combustion chamber;

providing said unitary slab with a guide structure extending linearly along a substantial length of the slab, said guide structure being adapted to engage a complementary structure located upon a tool used to clean the slab for purposes of positionally guiding said tool.

16. The method of refurbishing the floor of a crematory combustion chamber according to claim 15 wherein the providing step comprises forming a ridge upon said slab.

17. The method of refurbishing the floor of a crematory combustion chamber according to claim 15 wherein the providing step comprises forming a channel within said slab.

18. The method refurbishing the floor of a crematory combustion chamber according to claim 15 wherein the providing step comprises forming a channel adjacent opposite edges of said slab.

19. A method of refurbishing the floor of a crematory combustion chamber, said method comprising:

forming a unitary slab of material sufficient to withstand temperatures encountered during cremation, said unitary slab being sized to be received within the crematory combustion chamber;

inserting the unitary slab in a generally contiguous orientation within the floor area of the crematory combustion chamber, said slab forming, after full insertion into the crematory combustion chamber, a liner upon the crematory chamber floor; and removably affixing a cremains reservoir to said slab.

20. The method of refurbishing the floor of a crematory combustion chamber according to claim 19 wherein the step of removably affixing a cremains reservoir to the unitary slab comprises affixing the cremains reservoir to said slab by at least one dowell pin.

21. A floor liner for a crematory combustion chamber, said floor liner comprising a seamless unitary member including a guide member which cooperatively engages a complementary structure upon a cleaning tool for guiding such cleaning tool along a path upon said floor liner.

22. The floor liner for a crematory combustion chamber in accordance with claim 21 wherein said guide member comprises a ridge extending above the general plane of said floor.

23. A floor liner for a crematory combustion chamber in accordance with claim 22 wherein said guide member comprises a channel below the general plane of said floor.

24. A floor liner formed of material capable of withstanding crematory temperatures and sized and configured for insertion within a crematory combustion chamber, said floor liner having at least one cremains reservoir removably attached thereto.

25. The floor liner of claim 24 wherein said floor liner, when positioned within said combustion chamber, is generally coextensive with the area of the combustion chamber floor.

26. A floor liner formed of material capable of withstanding crematory temperatures and sized and configured for insertion within a crematory combustion chamber, said floor liner being provided with a guide structure for cooperatively engaging a cleaning tool and whereby said cleaning tool may be guided over a surface of said floor liner.

27. The floor liner of claim 26 wherein said floor liner, when positioned within said combustion chamber, is generally coextensive with the area of the combustion chamber floor.

28. The floor liner of claim 26 wherein said guide structure comprises a linear guide track extending along a straight line path on a surface of said floor liner.

29. The floor liner of claim 26 wherein said guide structure is formed along and parallel to the edge of said floor liner.

30. The floor liner of claim 26 wherein said guide structure comprises a ridge.

31. The floor liner of claim 26 wherein said guide structure comprises a channel adapted to cooperatively engage a cleaning tool.

32. A method of refurbishing the floor of a crematory combustion chamber, said method comprising the steps of:

forming a floor liner of material sufficient to withstand crematory temperatures, said floor liner being sized and configured for insertion within said crematory combustion chamber; and said floor liner being further provided with at least one cremains reservoir removably attached thereto.

33. A method of refurbishing the floor of a crematory combustion chamber, said method comprising:

forming a floor liner of material sufficient to withstand crematory temperatures, said floor liner being sized and configured for insertion within said combustion chamber; and providing said floor liner with a guide structure adapted to guide a cleaning tool over a surface of said floor liner.

34. The method of claim 33 wherein the providing step comprises forming a ridge upon a surface of said floor liner.

35. The method of claim 33 wherein the providing step comprises forming a channel within a surface of said floor liner.

36. The method of claim 33 wherein the providing step comprises forming a channel adjacent an edge of said floor liner.

37. The method fo claim 33 wherein the providing step further comprises providing a corresponding cleaning tool adapted to engage and be guided by said channel.

38. The method of claim 33 wherein the providing step further comprises providing a cleaning tool adapted to ride upon and be guided by said ridge.

39. The method of claim 33 wherein the providing step further comprises providing a cleaning tool adapted to ride within and be guided by said channel adjacent an edge of said floor liner.

* * * * *